United States Patent [19]

Nicolas

[11] Patent Number: 4,469,532

[45] Date of Patent: Sep. 4, 1984

[54] CHROMIUM-BASE COATING FOR WEAR-RESISTANT STEEL AND METHOD OF PREPARING SAME

[76] Inventor: Guy R. Nicolas, 22 Clos Nollet, 91200 Athis-Mons, France

[21] Appl. No.: 428,662

[22] Filed: Sep. 30, 1982

[30] Foreign Application Priority Data

Oct. 6, 1981 [FR] France ..... 81 18779

[51] Int. Cl.[3] ..... C23F 7/00

[52] U.S. Cl. ..... 148/6.35; 148/134; 148/6; 427/253; 427/383.9

[58] Field of Search ..... 148/6 B, 6, 6.35, 134; 427/383.9, 252, 253

[56] References Cited

U.S. PATENT DOCUMENTS 3,622,402 11/1971 Baranow ..... 148/6.35
3,712,798 1/1973 Thyme ..... 148/6 B

FOREIGN PATENT DOCUMENTS 55-138076 10/1980 Japan ..... 148/6
637460 12/1978 U.S.S.R. ..... 148/6
863709 9/1981 U.S.S.R. ..... 148/6

*Primary Examiner*—Sam Silverberg
*Attorney, Agent, or Firm*—Parkhurst & Oliff

[57] ABSTRACT

The invention concerns an abrasion resistent coating for steel and a method which makes it possible to obtain such a coating.

The coating comprises two surface layers. The first surface layer, the outer layer, is formed of the phase $(Cr, Fe)_2B$ and possibly the phase $M_{23}C_6$, while the second surface layer, the inner one, is formed of the phase $(Fe, Cr)_2B$. In order to obtain this coating, a boriding is effected on steels at a temperature less than or equal to 950° C. for a period of time greater than or equal to four hours, followed by a chromizing at a temperature less than or equal to 950° C. for a period of time greater than or equal to 10 hours.

Application to all steels in order to increase their resistance to wear is possible.

11 Claims, No Drawings

CHROMIUM-BASE COATING FOR WEAR-RESISTANT STEEL AND METHOD OF PREPARING SAME

The field of the present invention is chromium-base coatings for steel of high resistance to wear by abrasion, and processes employing vapor-phase chromizing.

Various surface treatments have been proposed in order to increase the hardness, resistance to wear by abrasion, corrosion resistance, and the like of parts of ferrous metal or steel, and, more generally, in order to improve the mechanical properties of surface layers. These principal treatments are, in particular, nitriding, boriding and chromizing.

French Pat. Nos. 2,018,609 and 2,450,286 describe boriding processes in which a metal part is subjected to a boriding activator at a temperature between 850° C. and 1100° C. for a sufficient period of time. In this way there is obtained a layer of iron borides which improves the wear-resistance of the treated steel.

The vapor chromizing of steels is well-known to those skilled in the art. Thus French Pat. No. 1,012,401 and its Patents of Addition 60,539 and 60,686 describe treatments which lead to the formation of chromium-base diffusion alloys on the surface of the steel.

The transport of chromium onto the surface of the material to be treated is effected by means of halides, which are the only chromium compounds which are in vapor state at the diffusion temperatures.

The deposition of chromium on the alloy to be treated is effected in accordance with two main reactions:

either (1) by exchange between chromium halide and iron in accordance with a reaction which, in the case of the chloride, is:

$$CrCl_2\,(g) + Fe\,(s) \overset{T}{\rightleftharpoons} FeCl_2\,(g) + Cr\,(s) \qquad (1)$$

or (2) by reduction of the chromium halide in a hydrogen medium in accordance with a reaction which, in the case of the chlorides, may be written:

$$CrCl_2\,(g) + H_2\,(g) \overset{T}{\rightleftharpoons} Cr\,(s) + 2HCl\,(g) \qquad (2)$$

The application of these methods of treatment to the surface of mild steels leads to obtaining surface layers having a high chromium content, which have the advantage of being rust proof, but do not have high degrees of hardness.

In the case of steels with a carbon content of more than 0.15%, and provided that the treatment is carried out at a temperature at which the steel is in austenitic state, the layer formed by chromizing consists of chromium carbides. These carbides are the carbide $M_{23}C_6$ in the layers closest to the surface and the carbide $M_7C_3$ in the subjacent layers. M designates here a metal which, in addition to chromium (Cr), may be iron (Fe), molybdenum (Mo), or vanadium (V). It is known that the hardnesses of $M_{23}C_6$ and $M_7C_3$ are about 1200 $HV_{0.01}$ and 2100 $HV_{0.01}$ respectively.

In the following text, the percents are always in masse.

More recently, variants in treatment have been proposed in order to increase the resistance to wear of the steels.

Thus French Pat. No. 2,439,824 proposes a method by which a steel containing at least 0.2% carbon is first subjected to ionic nitriding followed by a conventional vapor-phase chromizing at a temperature between 850° C. and 1100° C. The nitriding requires ionic bombardment of the specimen at a temperature of between 450° and 570° C. and a pressure of 2.5 to 8 millibars. It is stated that such a treatment makes it possible to effect practically complete elimination of the carbide $M_7C_3$ which gives rise to formation of cracks in or scaling of the steel. In this way a single surface layer of the carbide $M_{23}C_6$, of more than 30 μm, would be formed.

The nitriding treatment which forms the object of French Pat. No. 2,454,471 gives rise to limited enrichments in nitrogen (1 to 2%). After chromizing, this prior treatment will, in accordance with that French patent, make it possible to obtain layers of carbides of at least 20 μm while retaining a sufficiently fine austenitic grain size and the absence of deep decarburization.

In accordance with French Pat. No. 2,460,340, a nitriding treatment followed by chromizing can only be applied to steels having at least 0.8% carbon (0.8 to 2%). This double treatment is said to lead to the formation of "mixed layers probably formed of chromonitrides." These layers are said to avoid wear by abrasion while eliminating the fragility of the sharp edges of the parts treated in this manner. Furthermore, these parts are said to have good resistance to dry and wet corrosion.

More extensive metallurgical and tribological studies have been carried out on these different coatings and have made it possible to clarify, in the case of chromizing, the morphology, composition and resistance to wear of the layers obtained. Formed of the phases $M_{23}C_6$ and $M_7C_3$, the layers may also contain $Cr_2N$ nitrides when the halogen introduced into the cement is ammonium chloride $NH_4Cl$. These coatings have rather substantial resistance to wear but the morphology and the internal stresses of the carbide $M_7C_3$ limit their wear resistant capacity.

In the case of sequential treatments of nitriding followed by chromizing, it has been shown that the manner of nitriding (ionic or gaseous), or even the presence of carbonitrides, had no substantial influence on the nature of the component phases of the layers obtained. The predominant criterion has proven to be the initial thickness of the carbide layer. In general, the coatings obtained are distributed in two main sublayers. One, on the surface, is composed of the major phase $Cr_2$ (C,N) and of the carbide ($M_{23}C_6$). The other, the subjacent layer, is composed, to the extent of about one-half the thickness of the coating, of the carbide $M_7C_3$. However this carbide in this case still retains a columnar structure, which is detrimental to good resistance to wear.

Summarizing, therefore, the layers obtained by chromizing treatment, or nitriding followed by chromizing, in accordance with the prior art described in the aforementioned French patents, comprise a sublayer of chromium carbide $M_7C_3$. In its state of crystallization this carbide reduces the wear resistance of the chromized layers.

An object of the present invention is to provide a new coating and a method of obtaining it in which the formation of the carbide $M_7C_3$, with its basaltic crystallization, is avoided.

An object of the invention, therefore, is a coating for steel of high resistance to wear by abrasion, characterized by the fact that it comprises at least two surface layers, the first of which, located on the surface, essentially comprises the phase $(Cr,Fe)_2B$ while the other layer, the inner one, primarily comprises the phase $(Fe,Cr)_2B$, wherein Cr, Fe, B designate chromium, iron, boron, respectively.

In the formula $(Cr,Fe)_2B$, it is to be understood that the iron partially replaces the chromium in its network and vice versa in the formula $(Fe,Cr)_2B$. In both cases, the substitution is effected in a percentage of less than 18%.

The phase $(Cr,Fe)_2B$ may contain another phase of the type $M_{23}C_6$ in which M represents primarily chromium which also may be substituted by iron, vanadium, molybdenum, nickel or manganese.

The thickness of the first layer may advantageously be at least 12 μm and the thickness of the second at least 18 μm.

This coating is preferentially applied to a steel having a carbon content of at least 0.15%.

The invention also concerns a process for obtaining a coating on steel which is characterized by the fact that in the first step the steel in austenitic state is borided at a temperature of less than or substantially equal to 950° C. for a period of time greater than or substantially equal to 4 hours, and by the fact that in a second step chromizing is effected at a temperature lower than or substantially equal to 980° C. for a period of time greater than or substantially equal to 10 hours, which steps may be followed by a thermal hardening and tempering treatment.

The boriding can be effected in the presence of a boriding agent of the type $B_4C+Na_2B_4O_7$ in a vinyl binder in order to produce a layer of iron borides FeB and $Fe_2B$ of a thickness of at least 30 μm.

The layer of iron borides has a thickness close to 40 μm.

The chromizing may be effected in vapor phase in the presence of a cement comprising a 60:40 iron chromium powder, an anti-sintering agent ($Al_2O_3$), a carrier ($NH_4Cl$) and a hydrogen flow rate of about 300 liters per hour.

More particularly, the boriding is effected at 950° C. for four hours and the chromizing at 950° C. for 15 hours.

The process of the invention is applied to a low-alloy steel of type 35 CD 4.

As indicated above, the main advantage of the invention is that for the first time the formation of the carbide $M_7C_3$, both in the surface layer and in the deeper layers, can be avoided. Another advantage resides in the fact that the invention makes it possible to provide coatings which have a phase on their surface which contains chromium boride. It has not been previously possible to obtain such a coating. Thus, for the first time a coating containing chromium boride, the tribological properties of which are well known, can be made available without substantially modifying the chromizing treatment. The process of the invention can be applied to all types of steel, regardless of their carbon content.

In order to produce the coating which is the object of the present invention, one proceeds in the following or an equivalent manner.

A boriding treatment is first carried out with the steels, which may be alloyed or non-alloyed, and whose carbon content may, if necessary, be less then 0.10%. This treatment, independently of the technique employed (powder cementation, salt baths, EKABOR, slurry coating, ionic, etc.), should produce a compact layer of iron boride of at least 15 μm thickness.

After the boriding of a steel part, a layer of compounds having a base of the phases $Fe_2B$ and/or FeB is created on the surface of said part.

A barrier layer is thus formed which, during the chromizing, will make it possible to develop sublayers having a base of chromium boride ($Cr_2B$) and iron boride enriched in chromium $(Fe,Cr)_2B$. Depending on its thickness, the initial iron-boride layer limits to a greater or lesser extent the flow of carbon which can, after having migrated through it, combine with the chromim deposited during the course of chromization. If the initial iron-boride layer is of sufficient thickness, then only the carbide $M_{23}C_6$ can be formed, along with the boride $Cr_2B$.

After the thermochemical treatments, the heat treatments necessary for the acquisition of the internal characteristics of the substrate can be carried out. It is preferable to proceed with a new austenitizing after the chromizing, avoiding, if possible, water-quenching.

In order that the invention may be duly understood, an example is given below in order to demonstrate and emphasize importance of the thickness of the initial layer of compact iron boride. The steel used is a low alloy steel of type 35 CD 4 which is widely used in industrial production. In this example, three samples of the steel are borided, the first at 890° C. for 1½ hours, the second at 890° C. for 4 hours and the third at 950° C. for 4 hours.

The method of treatment is carried out in conventional manner, but under the aforementioned conditions, by "slurry coating" in the presence of $B_4C+Na_2B_4O_7$ in a vinyl binder. After this treatment, the three samples have a compact layer of iron borides FeB and $Fe_2B$ with thicknesses of 4, 15 and 40 μm respectively.

These three samples are then subjected to a conventional chromizing, but under the following conditions:

Cement:

ferrochromium powder: 60-40 antisintering agent: $Al_2O_3$ carrier: $NH_4Cl$ rate of flow off hydrogen: 300 liters/hour Rate of isothermal rise: 150° C./hour Thermal arrest: 950° C.

Time at thermal arrest: 15 hours

The nature of the cements does not form an object of the invention since the formation of these cements involve known techniques. However, the order of the treatments used and the temperatures reached during the treatments produce the results which lead to the invention.

After the chromizing treatment, the steel substrates are austenitized at 850° C., oil quenched, and then tempered at 250° C. for two hours.

Examination of the phases of the three samples by x-ray diffractometric analyses and analysis by Castaing electronic microprobe in correlation with the equilibrium diagrams, shows the following:

Sample 1—An initial layer of iron borides of 4 μm.

The layer of iron boride has been consumed and has given rise to the formation of a coating of chromium carbides $M_{23}C_6$ and $M_7C_3$ without any particularly substantial improvement in the state of crystallization of said latter carbide.

Sample 2—An initial layer of iron borides of 15 μm. In this case the $M_7C_3$ carbide layer has practically disappeared, its thickness being less than 1 μm. The $M_{23}C_6$ carbide, in the form of an independent sublayer, remains. However, a chromium boride $Cr_2B$ appears here with enrichment of the iron boride ($Fe_2B$) with chromium.

Sample 3—An initial layer of iron borides of 40 μm. The coating system in this sample is entirely different. The initial iron-boride thickness does not permit the carbon to reach the surface in sufficient content with respect to the transport kinetics of the chromium. Therefore, the formation of the carbide layer $M_7C_3$ has been eliminated and the course of diffusion in the system Fe, Cr, B, C at the chromization isotherm T is modified.

A layer, with a thickness of about 16 μm, consisting of the phases $Cr_2B$ and $Cr_{23}C_6$ in which iron is substituted (Fe less than or equal to 18%) is formed. Beneath this layer there is the phase consisting of the iron boride enriched in chromium by diffusion $(Fe,Cr)_2B$.

The hardness characteristics of these different phases are as follows:

| | | |
|---|---|---|
| Chromium carbide | $M_{23}C_6$ | 1600 ± 300 $HV_{0.02}$ |
| Chromium carbide | $M_7C_3$ | 2100 ± 250 $HV_{0.02}$ |
| Chromium boride with chromium carbide | $Cr_2B$ / $M_{23}C_6$ | 1400 ± 200 $HV_{0.02}$ |
| Iron boride enriched in chromium | $(Fe, Cr)_2B$ | 2400 ± 400 $HV_{0.02}$ |

These three samples were subjected to a standard wear test on a tribometer in pin-disk configuration, in accordance with the following test parameters:

samples 1, 2 and 3 in the form of flat disks of 35 CD 4 steel cylindrical pin with flat end of a diameter of 1.5 mm of 35 CD 4 steel, heat treated for a hardness of 310 $HV_{0.5}$, normal force IN, namely an apparent normal static stress of 0.56 MPa, circumferential speed: 500 rpm linear speed of contact: 41 m/minute laboratory temperature: 20° C.

dry friction stressing distance: 50 km.

The results obtained are set forth in the following table, as well as the results obtained with a reference sample which was treated by conventional chromatizing. It should be noted that the pins, which were not subjected to any specific treatment, exhibit extensive wear. Thus, it is essentially the wear of the disks which is to be observed.

| | Average wear in cubic milimeters/100 km | | |
|---|---|---|---|
| TYPE OF LAYER | DISK | PIN | CUMULATIVE |
| Reference sample | 1.20 | 1.80 | 3.00 |
| Sample 1 | 0.80 | 0.80 | 1.60 |
| Sample 2 | 0.74 | 1 | 1.74 |
| Sample 3 | 0.12 | 3.3 | 3.42 |

It should be noted that the layer configuration for which the $Cr_2B$ phase was constituted (Sample 3) gives results for resistance to wear which are particularly interesting when compared to those obtained after direct chromizing (Reference sample).

In the case of the 15 μm layer with initial boriding (Sample 2), the test results presented here are misleading, since in fact the wear in this case was limited to the $M_7C_3$ layer, it not having been possible to reach the $Cr_2B$ layer.

Therefore, in the case of Sample 3, the results speak for themselves, the wear of the disk being practically negligible. The coating of the invention can therefore be applied to any metal part whose wear is to be negligible as compared with another part the wear of which is substantial, such as a gun barrel and the banding of a shell, respectively, for example.

As to the morphology of the layers, the following points should be made: On the surface, the morphology of the layers is typically that of the $M_{23}C_6$ phase. But in contrast to the layers obtained by direct chromizing, the crystals of chromium carbonitride $Cr_2(C,N)$ are very rare in the case of the boron-chromizing.

In cross-section the coating of Sample 1 is formed of two sublayers $M_{23}C_6$ and $M_7C_3$, which are of the same appearance as the chromized layers. On the other hand, the coating of sample 2 is composed of three sublayers $M_{23}C_6$, $M_7C_3$ and $(Cr,Fe)_2B$, below which is found the general morphology of the iron boride layer which was not completely consumed during the exchanges.

As to Sample 3, one no longer observes sublayers as such, the coating being present in the form of a polyphase band of $(Cr,Fe)_2B$ and $M_{23}C_6$ below which there is the layer of initial iron boride which was not consumed during the exchanges.

What is claimed is:

1. A method for obtaining an abrasion resistant coating on steel, comprising:

a first step comprising boriding steel in an austenitic state at a temperature less than or substantially equal to 950° C. for a period of time greater than or substantially equal to 4 hours to form a layer of iron-borides $Fe_2B$, FeB of a thickness of at least 30 μm; and a second step comprising chromizing said steel at a temperature less than or substantially equal to 980° C. for a period of time greater than or substantially equal to 10 hours; wherein said method produces a coating on said steel consisting of an outer layer and an inner layer, said outer layer consisting essentially of the phase $(Cr,Fe)_2B$ of a thickness of at least 12 μm and said inner layer consisting essentially of the phase $(Fe,Cr)_2B$ of a thickness of at least 18 m, wherein $Cr_1Fe$, and B designate chromium, iron, and boron respectively.

2. The method of claim 1, wherein said first and second steps are followed by a thermal hardening and tempering treatment.

3. The method of claim 1, wherein the boriding is effected in the presence of a boriding agent of the type $B_4C+Na_2B_4O_7$ in a vinyl binder and produces a layer of iron borides FeB and $Fe_2B$ of at least 30 μm in thickness.

4. The method of claim 3, wherein the layer of iron borides has a thickness of 40 μm.

5. The method of claims 1, 2, 3, or 4, wherein the chromizing is effected in vapor phase in the presence of a cement comprising a 60:40 iron:chromium powder, an anti-sintering agent ($Al_2O_3$), a carrier ($NH_4Cl$) and hydrogen at a flow rate of abut 300 liters per hour.

6. The method of claim 5, wherein the boriding is effected at 950° C. for 4 hours and the chromizing at 950° C. for 15 hours.

7. The method of claim 6, wherein said abrasion resisting coating is applied to a low alloy steel of type 35 CD 4.

8. The method of claim 1, wherein the layer of iron borides has a thickness of 40 μm.

9. The method of claim 1, wherein the boriding is effected at 950° C. for 4 hours and the chromizing at 950° C. for 15 hours.

10. The method of claim 9, wherein said abrasion resisting coating is applied to a low alloy steel of type 35 CD4.

11. The method of claim 1, wherein said abrasion resisting coating is applied to a steel having a carbon content of at least 0.15%.

* * * * *